US009017115B2

(12) United States Patent
Connell

(10) Patent No.: US 9,017,115 B2
(45) Date of Patent: Apr. 28, 2015

(54) ELECTRICAL ASSEMBLY

(71) Applicant: Control Techniques Ltd, Newtown (GB)

(72) Inventor: Hugh A Connell, Evesham (GB)

(73) Assignee: Control Techniques Ltd, Newtown (GB)

( * ) Notice: Subject to any disclaimer, the term of this patent is extended or adjusted under 35 U.S.C. 154(b) by 0 days.

(21) Appl. No.: 13/743,468

(22) Filed: Jan. 17, 2013

(65) Prior Publication Data

US 2013/0183871 A1 Jul. 18, 2013

(30) Foreign Application Priority Data

Jan. 17, 2012 (GB) ..... 1200792.8

(51) Int. Cl.

| | |
|---|---|
| ***H01R 4/48*** | (2006.01) |
| ***H01R 12/70*** | (2011.01) |
| ***H01R 12/71*** | (2011.01) |
| ***H01R 13/24*** | (2006.01) |

(52) U.S. Cl.

CPC ..... *H01R 4/4809* (2013.01); *H01R 12/7082* (2013.01); *H01R 12/714* (2013.01); *H01R 13/2435* (2013.01)

(58) Field of Classification Search

USPC ..... 439/862, 74, 66, 81

See application file for complete search history.

(56) References Cited

U.S. PATENT DOCUMENTS

| | | | | |
|---|---|---|---|---|
| 3,753,048 | A * | 8/1973 | Tuck et al. | 361/785 |
| 4,623,207 | A * | 11/1986 | Sasaki et al. | 439/59 |
| 4,806,104 | A * | 2/1989 | Cabourne | 439/66 |
| 5,215,471 | A * | 6/1993 | Reymond et al. | 439/66 |
| 5,378,160 | A | 1/1995 | Yumibe et al. | |
| 6,290,507 | B1 * | 9/2001 | Neidich et al. | 439/66 |
| 6,787,709 | B2 * | 9/2004 | Vinther | 174/260 |
| 8,043,098 | B2 | 10/2011 | Huang | |

FOREIGN PATENT DOCUMENTS

| | | |
|---|---|---|
| EP | 0974176 | 1/2000 |
| EP | 1058352 | 12/2000 |
| WO | 9805093 | 2/1998 |

* cited by examiner

*Primary Examiner* — Phuong Dinh

(74) *Attorney, Agent, or Firm* — Harness, Dickey & Pierce, P.L.C.

(57) ABSTRACT

A demountable electrical panel comprises a spring under tension that is easily assembled by being laid to rest in a recess in a mounting plate put under tension to make electrical contact with a circuit board when the device is assembled.

20 Claims, 5 Drawing Sheets

ELECTRICAL ASSEMBLY

CROSS-REFERENCE TO RELATED APPLICATION

Figure 1A:
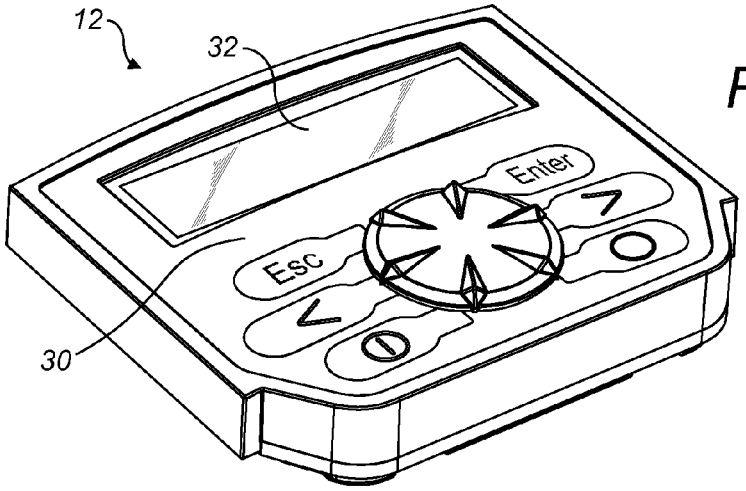

This application claims the benefit and priority of Great Britain Patent Application No. GB 1200792.8, filed Jan. 17, 2012. The entire disclosure of the above application is incorporated herein by reference.

This invention relates to an electrical assembly.

The assembly of electrical products often involves the need to make an electrical contact in the assembling process. This is an aspect of assembly that is prone to failure. One reason is that the contacts are not made due to a badly sited contact.

An example of such an assembly is a demountable control panel for an electric controller for, for example, an electrical motor drive. The panel is demountable from a mounting plate attached to the controller for various reasons. One might be for security purposes so that the settings of the controller cannot be altered without the panel being in place. Another is that a single control panel can be used for setting up multiple controllers by removing the panel from controller to controller in turn. Such panels have to make electrical contact with contacts on the mounting plate. Assembly of such a demountable control panel involves a reliably and accurately arranging projecting (or recessed but otherwise exposed) contacts that mate with corresponding contacts on the mounting plate.

A typical electrical assembly such as a control panel as described above will include a circuit board on which are mounted various components. These are often connected by means of surface mount or a through-hole soldering process. The circuit board is typically loaded with components on both sides. The surface mount form of connection for the components requires the use of an oven to melt the solder. This is incompatible with through-hole soldering if both sides of the board are to be used. Mounting all the components on one side of the board is an option but in a situation in which the board is part of a demountable component it is convenient to mount at least the contacts for the mounting plate on the back of the board. Thus, rather than soldering the contacts in place, it is preferable to use physical contact to avoid the need for a second solder melting step for the contacts alone.

It would be desirable to be able to produce an assembly that is simple and reliable.

Aspects of the disclosed embodiments are defined in the accompanying claims.

According to disclosed embodiments an electrical assembly comprises a first member having a recess, and a circuit board mounted on the first member and having an electrical contact region on a first side, the assembly further comprising a spring contact engaged under tension with the electrical contact in a first region and with the recess in a second region.

In a particular form disclosed an electrical assembly comprises a first member and a circuit board mounted on the first member and having a contact on a first side, the member having a recess, and a spring contact under tension between the first member and the circuit board, the spring contact defining a projection that rests within the recess and an arm extending from the projection that is in contact with the contact on the circuit board under tension, thereby urging the projection to seat within the recess.

Preferably, the recess is an open hole and the projection defines a contact nub in the region of the hole.

Preferably the nub projects through the hole.

Preferably the arm comprises a first portion extending in a first direction from the projection. Preferably the arm further comprises a second portion extending in another direction from the end of the first portion distal from the projection. The free end of the second portion engages the contact on the first side of the circuit board.

Figure 1B:
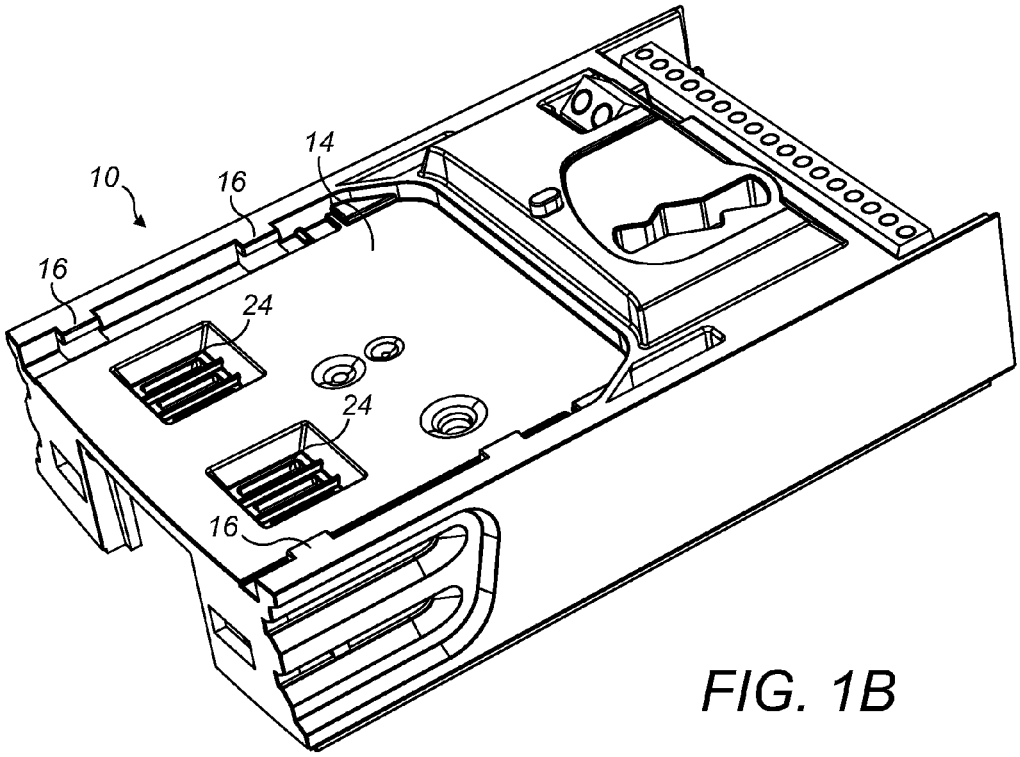
Figure 1C:
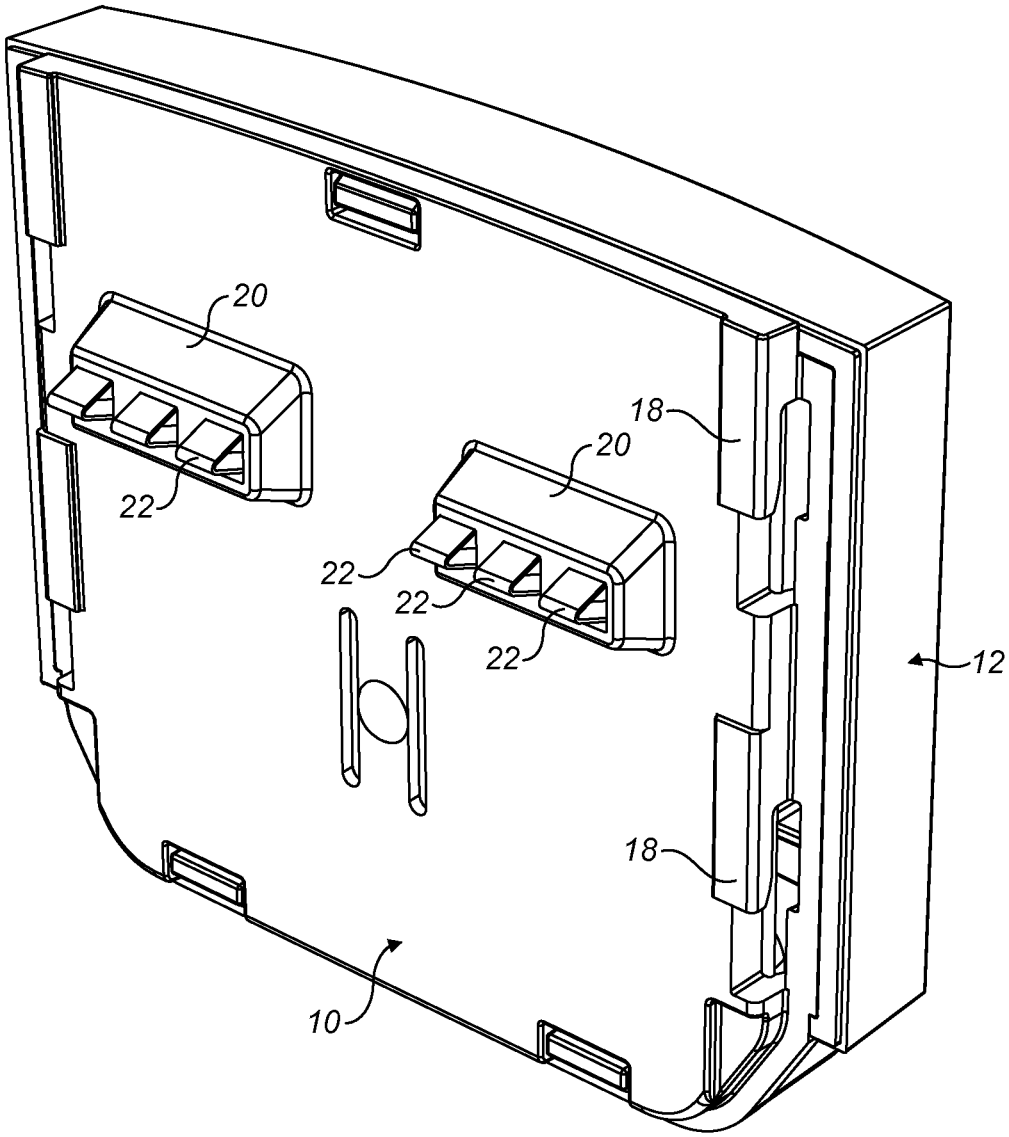
Figure 2A:
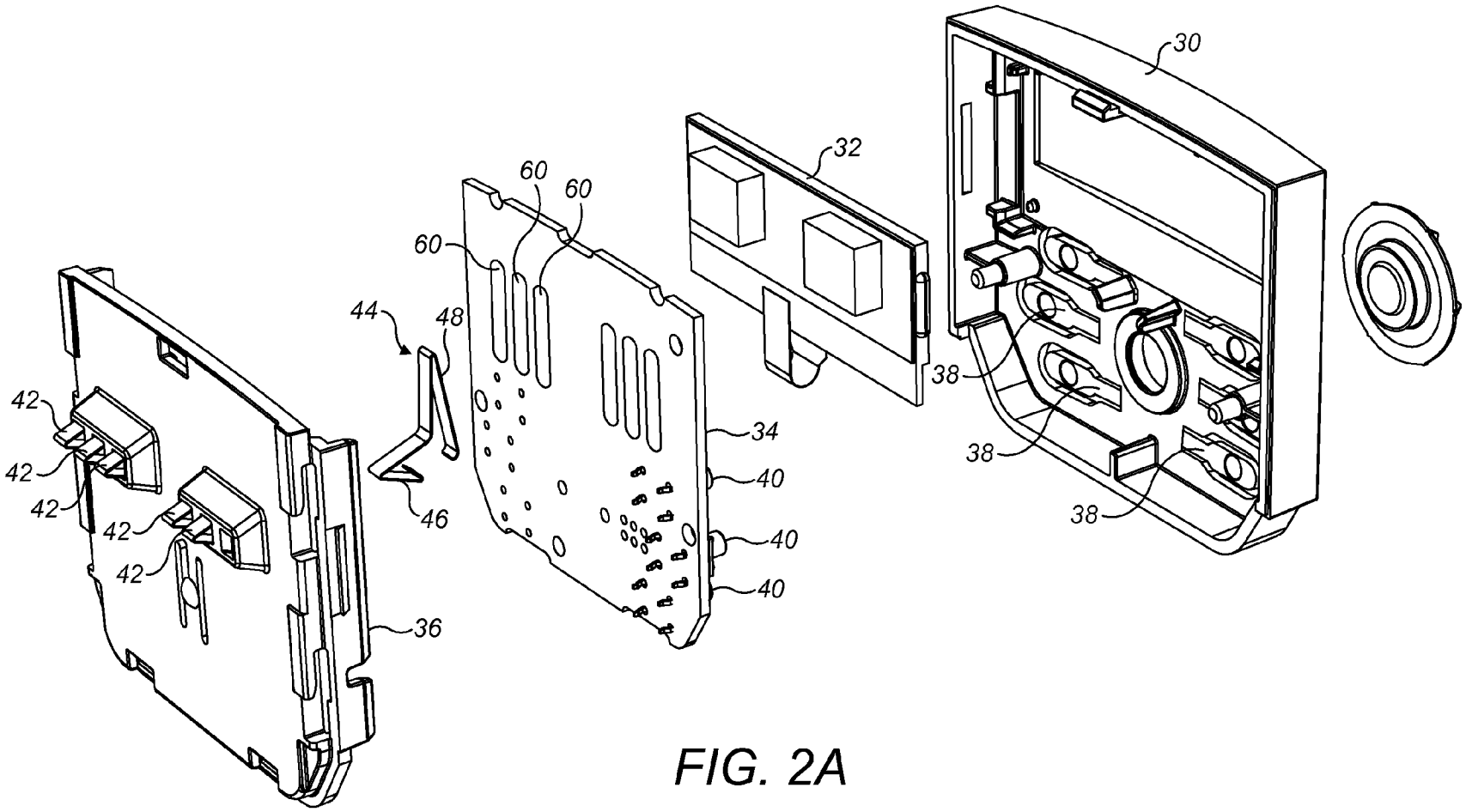
Figure 2B:
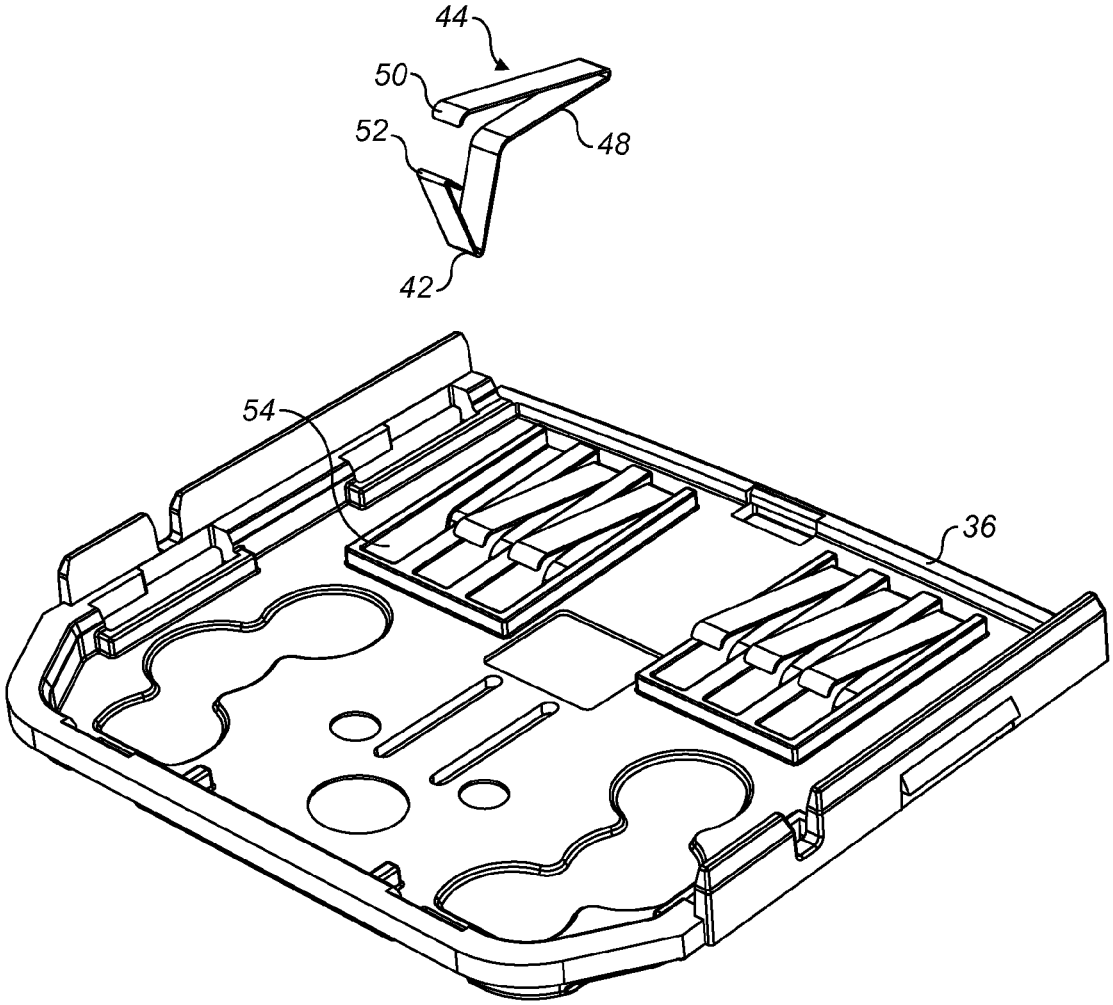
Figure 3:
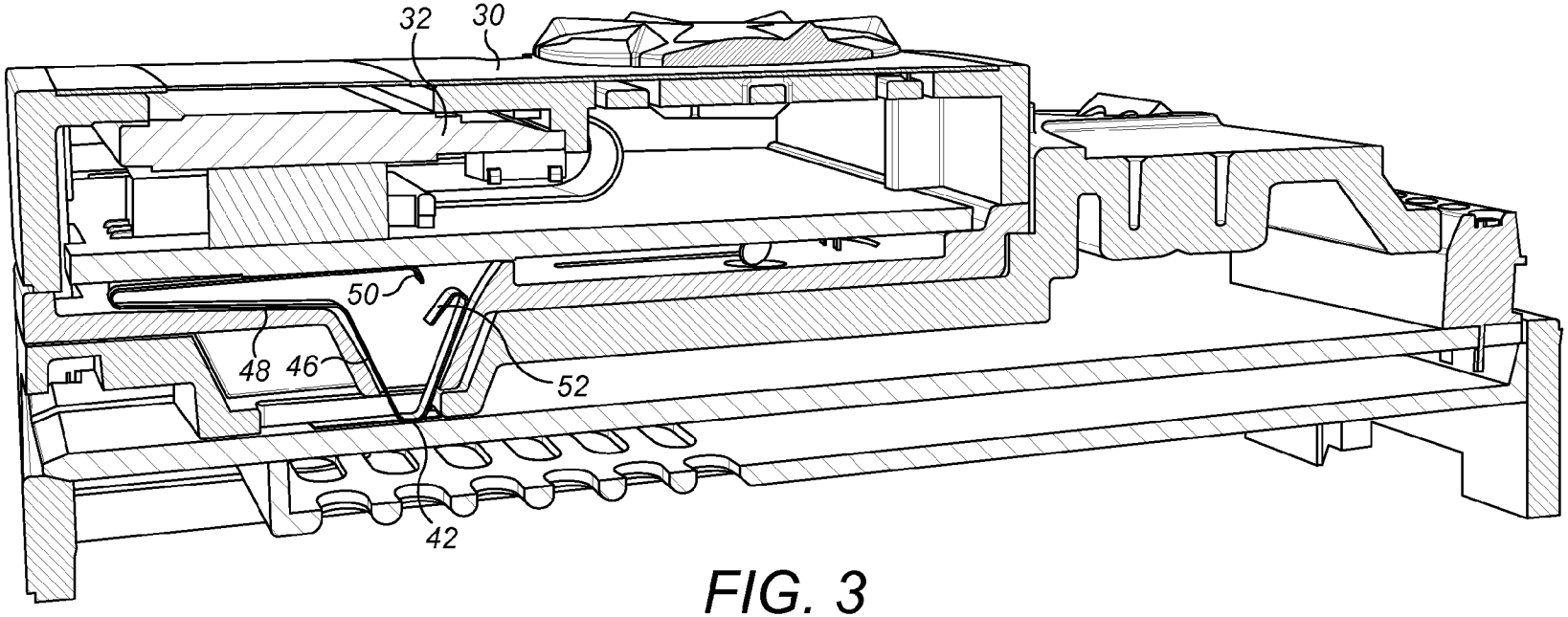

Various embodiments will now be described by way of example with reference to the accompanying drawings in which:

FIGS. 1A-C show the components of a control panel assembly for an electrical control system;

FIGS. 2A-B show an expanded view of a demountable control panel of the assembly of FIG. 1;

FIG. 3 shows a cross-section of the control panel of FIG. 2A when assembled.

In this embodiment an electrical assembly comprises a mounting plate 10 fixed to a controller (not shown). A control panel 12 is mountable on the mounting plate 10.

The mounting plate 10 is a moulded rigid plastics component defining a recessed seat 14 for the panel 12. The two components are assembled by a slide-and-lock action by the mutual engagement of dogs 16 and 18, respectively, on the plate and the panel.

The back of the panel defines two regions 20 from which protrude contacts 22 which engage contacts 24 on the mounting plate 10. By mutual engagement of the dogs 16 and 18 in the mounting process, the contacts 22 are first depressed and then slide over the contacts 24 to form an electrical connection so that power and/or data can pass between the control panel and the controller on which the mounting plate 10 is fixed.

Referring to FIGS. 2A-B the control panel 12 comprises a front fascia 30, a display 32, a circuit board 34 and a back plate 36. The fascia 30 is clipped or otherwise fixed in position on the back plate 36 to hold the display 32 and the circuit board 34 in position. Resilient buttons 38 are formed in the fascia which are in registry with switches 40 on the circuit board 34.

Each contact 22 is the nub 42 of a spring contact 44 made of beryllium copper. Other suitably resilient and electrically conductive materials can be used. The spring contact 44 comprises a V-shaped portion 46, the tip of which is the nub 42. One arm of the V-shaped portion is extended as a first limb 48 which is bent over on itself to project back across the open end of the V-shaped portion 46. The ultimate ends 50 and 52 of the spring contact 44 are each bent over to avoid exposed sharp edges.

In assembling the panel 12, the spring contacts 44 are laid to rest each in a respective aperture 54 in the mounting plate 10 while the plate is lying generally in the position as shown in FIG. 2B. There is no retaining mechanism for the spring arms in the assembly process such as detents or clips. This is advantageous as the spring contacts are allowed to simply rest in position. No positive force is needed to push them home and hold them in position. This means the contacts 44 are far more reliably seated than if it were necessary for them to be retained in some way requiring physical force for them to be pushed home. Once the spring contacts are in place the board and the display are offered up to the mounting plate and the fascia clipped in place to hold the assembly together.

Referring to FIG. 3 in the assembled control panel mounted on a controller front board 58 it will be seen that the shape of the walls of the apertures is generally congruent with the angle defined by the arms of the V-shaped portion 46. This mutual V-shape encourages the spring contact 44 to seat accurately and easily in the assembly process. Other shapes of contact and recess could be used to equal effect, such as a radius configuration or a sequence of steps or other shapes approximating to a generally tapering shape for the contact to seat in. A parallel walled aperture and a tapered arm is also possible as it will also encourage the arm to seat accurately in the aperture.

Once seated, it will be seen that the nub 42 of each spring contact protrudes through the aperture and is available to make the electrical connection with contacts on the mounting plate. Likewise, the mounted components of the control panel put the spring contact under tension to hold it in place and also to provide a force for maintaining the electrical connection with the corresponding contact 60 on the circuit board 34.

In FIG. 3 the assembly is mounted on the controller board 58 so that electrical contact is made between each nub 42 and a corresponding electrically conductive element 24 so that power/data can be exchanged. The protruding nubs 42 are pushed back due to the contact with the elements 24 exerting an increased force on the contact between the end 50 and the contact element 60 on the circuit board. This raises the spring contact from engagement with the recess but it is still held in place for reliable electrical contact to be maintained.

The assembly is simple and reliable in assembly because there is no retaining force required to hold the spring arm in place before assembly is complete. It also does not require the use of solder for electrical contact to be made between the one side of the circuit board and the contact. The invention can be used in electrical assemblies whether demountable or permanent and is not restricted to the controller of the specific embodiment.

The invention claimed is:

1. An electrical assembly comprising:

a first member having a tapered recess;

a circuit board mounted on the first member, the circuit board having an electrical contact on a first side; and a bent spring contact having a uniform width and a uniform thickness and being at least partially in the tapered recess, wherein:

a substantially flat first region of the bent spring contact is resiliently engaged with the electrical contact; and a second region of the bent spring contact projects into and beyond the tapered recess.

2. An assembly as claimed in claim 1 in which the bent spring contact defines a projection resting within the tapered recess and an arm extending from the tapered recess defining the substantially flat first region in contact with the electrical contact.

3. An assembly as claimed in claim 1 in which the tapered recess defines a hole.

4. An assembly as claimed in claim 1 in which the second region of the bent spring contact comprises connected arms defining a taper projecting into the tapered recess.

5. An assembly as claimed in claim 1 in which the substantially flat first region of the bent spring contact comprises a limb extending from the second region.

6. An assembly as claimed in claim 5 in which the limb comprises a first part connected to the second region extending from the second region in one direction and a second part connected to the first part and extending generally in the opposite direction.

7. An assembly as claimed in claim 6 in which the second region of the spring arm defines a nub between the connected arms which projects through the hole.

8. An assembly as claimed in claim 2 in which the tapered recess defines a hole.

9. An assembly as claimed in claim 2 in which the second region of the bent spring contact comprises connected arms defining a taper projecting into the tapered recess.

10. An assembly as claimed in claim 3 in which the second region of the bent spring contact comprises connected arms defining a taper projecting into the tapered recess.

11. An assembly as claimed in claim 8 in which the second region of the bent spring contact comprises connected arms defining a taper projecting into the tapered recess.

12. An assembly as claimed in claim 2 in which the substantially flat first region of the spring contact comprises a limb extending from the second region.

13. An assembly as claimed in claim 3 in which the substantially flat first region of the bent spring contact comprises a limb extending from the second region.

14. An assembly as claimed in claim 8 in which the substantially flat first region of the bent spring contact comprises a limb extending from the second region.

15. An assembly as claimed in claim 4 in which the substantially flat first region of the bent spring contact comprises a limb extending from the second region.

16. An assembly as claimed in claim 9 in which the substantially flat first region of the bent spring contact comprises a limb extending from the second region.

17. An assembly as claimed in claim 10 in which the substantially flat first region of the bent spring contact comprises a limb extending from the second region.

18. An assembly as claimed in claim 11 in which the substantially flat first region of the bent spring contact comprises a limb extending from the second region.

19. An assembly as claimed in claim 12 in which the limb comprises a first part connected to the second region extending from the second region in one direction and a second part connected to the first part and extending generally in the opposite direction.

20. An assembly as claimed in claim 13 in which the limb comprises a first part connected to the second region extending from the second region in one direction and a second part connected to the first part and extending generally in the opposite direction.

* * * * *